US010907821B2

(12) United States Patent
Magee et al.

(10) Patent No.: US 10,907,821 B2
(45) Date of Patent: Feb. 2, 2021

(54) HRSG WITH STEPPED TUBE RESTRAINTS

(71) Applicant: General Electric Company, Schenectady, NY (US)

(72) Inventors: Jeffrey Frederick Magee, Longmeadow, MA (US); Van Dang, Bloomfield, CT (US); Paul John Chapman, Windsor, CT (US); Aaron James Yeaton, Portland, CT (US)

(73) Assignee: General Electric Company, Schenectady, NY (US)

( * ) Notice: Subject to any disclaimer, the term of this patent is extended or adjusted under 35 U.S.C. 154(b) by 62 days.

(21) Appl. No.: 16/295,524

(22) Filed: Mar. 7, 2019

(65) Prior Publication Data

US 2020/0284426 A1 Sep. 10, 2020

(51) Int. Cl.
*F22B 1/18* (2006.01)
*F15D 1/04* (2006.01)

(52) U.S. Cl.
CPC ..... *F22B 1/1815* (2013.01); *F15D 1/04* (2013.01)

(58) Field of Classification Search
CPC ..... F22B 1/1815; F15D 1/04
USPC ..... 138/106; 248/68.1
See application file for complete search history.

(56) References Cited

U.S. PATENT DOCUMENTS 4,036,289 A * 7/1977 Cheng ..... F28F 9/0132 165/82
4,108,408 A * 8/1978 Butti ..... F16L 3/223 248/68.1
4,244,542 A * 1/1981 Mathews ..... F16L 3/222 138/112
4,648,442 A * 3/1987 Williams ..... F28F 9/0132 165/162
6,019,070 A * 2/2000 Duffy ..... F22B 1/1815 122/209.1
8,695,688 B2 * 4/2014 Schneider ..... F28D 7/06 122/510
10,502,493 B2 * 12/2019 Freund ..... F28F 1/24
2011/0048010 A1 * 3/2011 Balcezak ..... F22B 1/1815 60/645
2012/0073666 A1 3/2012 Hjelmberg et al.
2013/0312858 A1 11/2013 Cohen et al.
2015/0184775 A1 * 7/2015 Koski ..... F22B 37/205 248/68.1
2016/0376986 A1 * 12/2016 Ferris ..... F02G 5/02 165/173
2017/0010053 A1 * 1/2017 Shenoy ..... F28F 9/02
2017/0355046 A1 * 12/2017 Giuliano ..... B66F 3/12

* cited by examiner

*Primary Examiner* — Craig M Schneider
*Assistant Examiner* — David R Deal
(74) *Attorney, Agent, or Firm* — Charlotte C. Wilson; James W. Pemrick

(57) ABSTRACT

A heat recovery steam generator (HRSG) includes: a plurality of vertically-aligned HRSG tubes; and a plurality of stepped tube restraints coupled to the plurality of vertically aligned HRSG tubes. Each stepped tube restraint includes a plurality of tube restraints. The plurality of tube restraints are arranged in an array such that each successive tube restrain is vertically higher than and axially aft of an adjacent tube restraint.

18 Claims, 7 Drawing Sheets

HRSG WITH STEPPED TUBE RESTRAINTS

BACKGROUND

The present subject matter relates generally to boiler and/or steam generator tubes, and more specifically to stepped tube restraints for heat recovery steam generators (HRSG).

Heat recovery steam generators (HRSG), as well as boilers more generally, include several possible configurations including various arrangements of piping, tubes, orifices, baffles, flow conduits, and other components. Heat recovery steam generators installed at power plants use exhaust gases from gas turbine engines to produce steam at various pressures, temperatures, and flow rates for use in power-producing steam turbine generators, as well as for other possible industrial processes and/or purposes (for example, at co-gen facilities).

Heat recovery steam generators interface with gas turbine engines at a gas turbine exhaust and/or HRSG inlet. At the interface between gas turbines and HRSG, hot exhaust gases from the gas turbine expand as they travel toward the HRSG. Because many heat recovery steam generators are substantially larger (i.e., taller) than gas turbines, the flow area at the HRSG is greater than that of the gas turbine exhaust/HRSG inlet, even at an expanded end of the HRSG inlet duct. Therefore, distributing exhaust gases evenly across the HRSG may prove difficult and may result in increased pressure losses and lower HRSG effectiveness.

HRSG bulk effectiveness depends on a number of factors including the surface area of the tubes, the internal flow area of the tubes, and the heat conductivity of the tube material, as well as the angles at which exhaust flow is directed when it enters the HRSG, and the various changes of direction the exhaust flow must make to reach the upper portions of the HRSG. In addition, other design constraints factor into the design of HRSG including ensuring a minimal tube strength is maintained, accounting for pressure losses of the fluid within the tubes, initial construction costs, ongoing maintenance costs, as well as the general durability of the tubes, and their susceptibility to degradation.

BRIEF DESCRIPTION OF THE EMBODIMENTS

Aspects of the present embodiments are summarized below. These embodiments are not intended to limit the scope of the present claimed embodiments, but rather, these embodiments are intended only to provide a brief summary of possible forms of the embodiments. Furthermore, the embodiments may encompass a variety of forms that may be similar to or different from the embodiments set forth below, commensurate with the scope of the claims.

In one aspect, a heat recovery steam generator (HRSG) includes: a plurality of vertically-aligned HRSG tubes; and a plurality of stepped tube restraints coupled to the plurality of vertically aligned HRSG tubes. Each stepped tube restraint includes a plurality of tube restraints. The plurality of tube restraints are arranged in an array such that each successive tube restrain is vertically higher than and axially aft of an adjacent tube restraint.

In another aspect, a heat recovery steam generator (HRSG) includes: a plurality of vertically-aligned HRSG tubes; and a plurality of stepped tube restraints coupled to the plurality of vertically aligned HRSG tubes. Each stepped tube restraint includes a plurality of tube restraints. Each stepped tube restraint forms an angle with a horizontal axis between about 10 degrees and about 60 degrees.

In another aspect, a heat recovery steam generator (HRSG) includes: a plurality of vertically-aligned HRSG tubes; and a plurality of angled tube restraints coupled to the plurality of vertically aligned HRSG tubes. Each angled tube restraint includes one or more planar tube restraint. Each angled tube restraint forms an angle with a horizontal axis between about 10 degrees and about 60 degrees.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the term "axial" refers to a direction aligned with a central axis or shaft of a generator and/or turbine, and/or aligned with the substantially horizontal direction with which gases flow through an HRSG from an inlet end toward an exhaust end (i.e., at the stack). As used herein, the term "longitudinal" may be used synonymously with the term "axial."

As used herein, the term "circumferential" refers to a direction or directions around (and tangential to) the outer circumference of the generator, turbine, and/or HRSG tube, or for example the circle defined by the swept area of the rotor of the generator and/or turbine. As used herein, the terms "circumferential" and "tangential" may be synonymous.

As used herein, the term "radial" refers to a direction moving outwardly away from the central axis of the generator, turbine and/or HRSG tube. A "radially inward" direction is aligned toward the central axis moving toward decreasing radii. A "radially outward" direction is aligned away from the central axis moving toward increasing radii.

Figure 1:
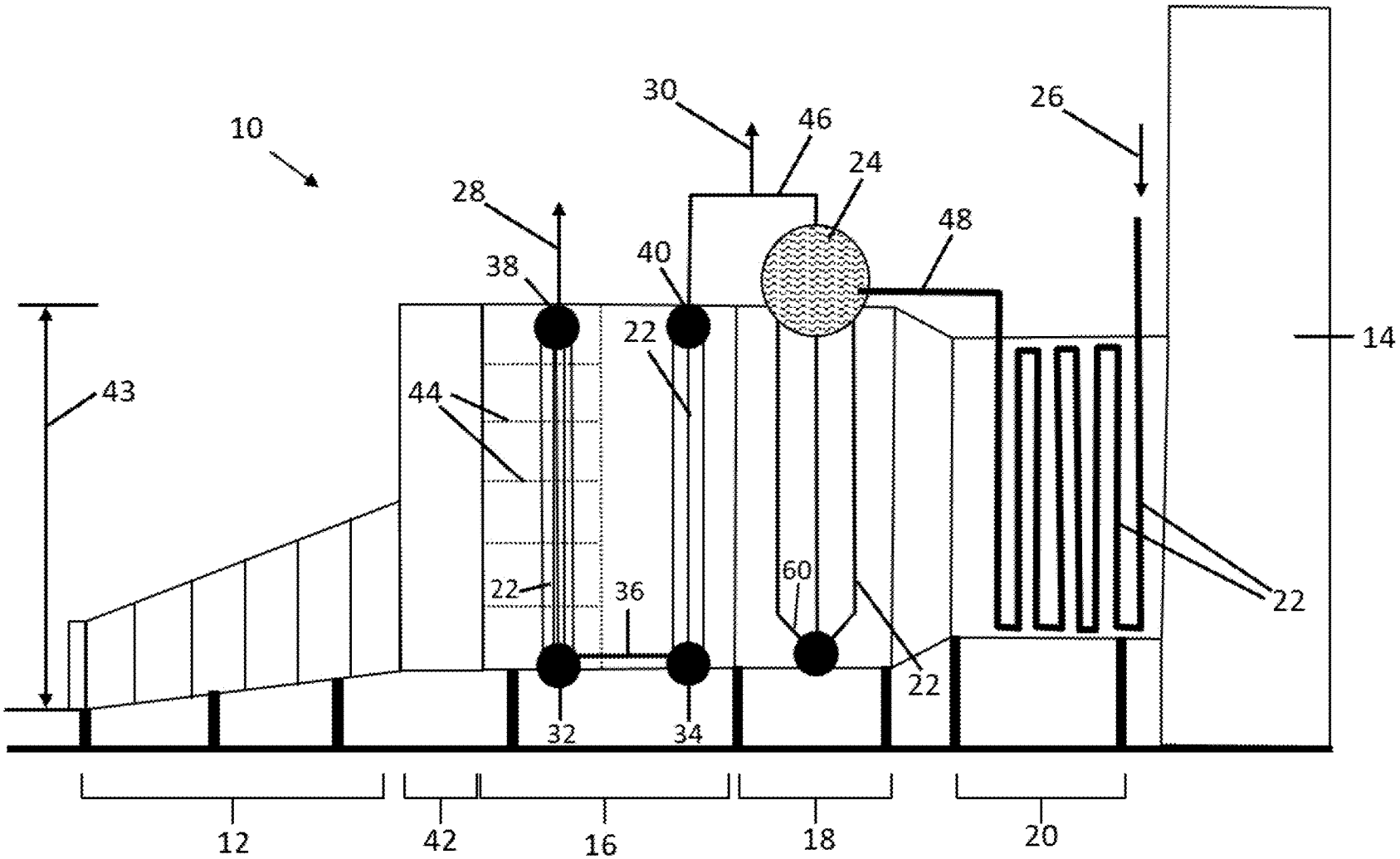
FIG. 1 is a side schematic representation of a heat recovery steam generator (HRSG)

FIG. 1 illustrates an exemplary heat recovery steam generator (HRSG) 10. The HRSG 10 may include an inlet duct 12 (or gas turbine exhaust portion) for receiving exhaust gases from a gas turbine (not shown). The HRSG 10 may also include a superheater section 16, an evaporator section 18, and an economizer section 20. Each of the superheater, evaporator, and economizer sections 16, 18, 20 may include a plurality of tubes 22, as well as other piping, baffles, and other components used to generate steam from the exhaust gases. The HRSG 10 may also include a stack 14 through which exhaust gases may exit after flowing through the HRSG 10. The HRSG 10 of FIG. 1 may be a conventional HRSG and/or a once-through HRSG, and as such, HRSG 10 may or may not include a high-pressure drum 24 and/or other drums (i.e., intermediate and/or low-pressure drums).

Referring still to FIG. 1, the HRSG 10 may include a feedwater source 26 for providing feedwater to the economizer section 20, as well as first and second steam lines 28, 30 for delivering steam to one or more steam turbines (not shown) and/or other downstream industrial processes. The superheater section 16 may include a first stage 32, as well as a second stage 34 fluidly coupled to the first stage 32 via one or more first interconnect lines 36. The first stage 32 may include a first steam header 38 while the second stage 34 may include a second steam header 40. The HRSG 10 may also include a second interconnect line 46 fluidly coupling the superheater section 16 to the evaporator section 18 via the high-pressure drum 24. The HRSG 10 may also include a third interconnect line 48 fluidly coupling the economizer section 20 to the evaporator section 18 via the drum 24. Each tube 22 within each of the superheater, evaporator, and economizer sections 16, 18, 20 may include an angled portion 60 to facilitate delivering the internal fluids (steam, water, ammonia, and/or other fluids) to one or more drums 24, headers 38, 40, and/or other conduits or plenums, while also maximizing the portion of each tube aligned in a vertical direction (i.e., normal to the direction in which oncoming exhaust gases are flowing, thereby enhancing heat transfer).

Still referring to FIG. 1, the HRSG 10 may include one or more tube restraints 44 horizontally aligned in each of the superheater, evaporator, and economizer sections 16, 18, 20. The one or more tube restraints 44 may be used for aligning the flow of exhaust gases horizontally (i.e., axially) as they flow through each of the superheater, evaporator, and economizer sections 16, 18, 20. The one or more tube restraints 44 may be used for axially supporting the tubes 22 so as to provide additional robustness in operation when the axially gases act with force (i.e., in an axial direction) on the tubes 22. By coupling the tubes together with the tube restraints, the combined strength of the tubes in an axial direction may be used to counteract the forces caused by the exhaust gases acting on the tubes. The HRSG 10 may include an inlet plenum 42 upstream of each of the superheater, evaporator, and economizer sections 16, 18, 20 and downstream of the inlet duct 12. The inlet plenum 42 receives exhaust gases from the inlet duct 12 and vertically distributes them through the full vertical height 43 of the HRSG 10 such that heat transfer may occur in both the upper portions of the HRSG 10, as well as the lower portions of the HRSG 10.

Figure 2:
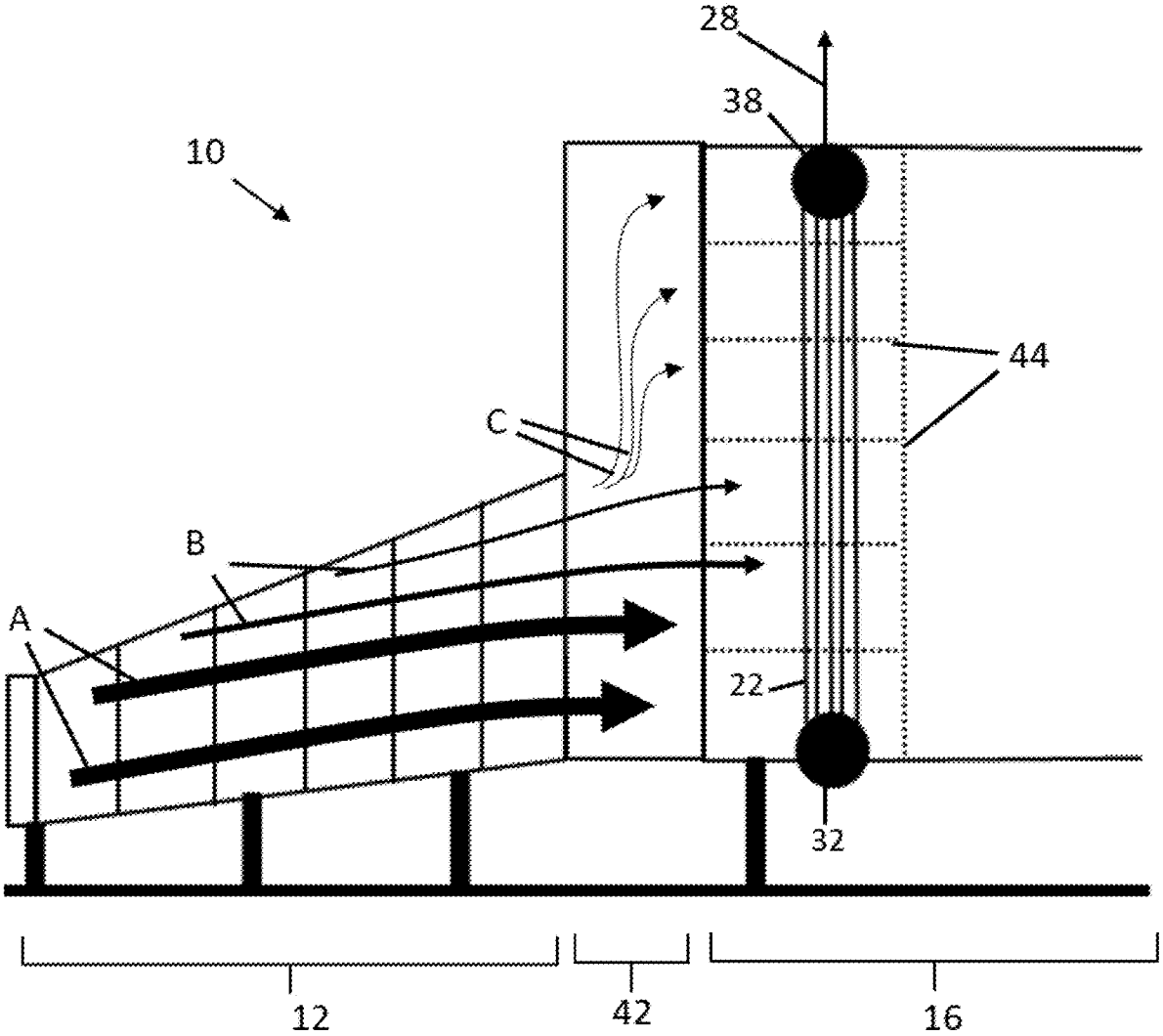
FIG. 2 is a side schematic representation of a portion of a heat recovery steam generator (HRSG)

FIG. 2 illustrates a side view of a portion of the HRSG 10 of FIG. 1 including the inlet duct 12, the inlet plenum 42, and a portion of the superheater section 16. FIG. 2 illustrates a plurality of large exhaust flow arrows A diagrammatically illustrating higher mass flows at lower portions of HRSG 10. Similarly, FIG. 2 illustrates a plurality of medium exhaust flow arrows B diagrammatically illustrating medium-sized mass flows at mid-height portions of HRSG 10. Similarly, FIG. 2 illustrates a plurality of lower exhaust flow arrows C diagrammatically illustrating lower mass flows at upper portions of HRSG 10. Because the inlet duct 12 is positioned proximate the lower half of the HRSG, and because exhaust gases must make two sharp turns to reach the upper portions of the HRSG, higher exhaust mass flow enters the lower portions of the HRSG than the upper portions of the HRSG. As a result, HRSG 10 may operate at a lower than optimal overall effectiveness due to uneven flow distribution vertically across the HRSG 10, which in turn may result in under-utilization of the upper portions of the HRSG 10.

Figure 3:
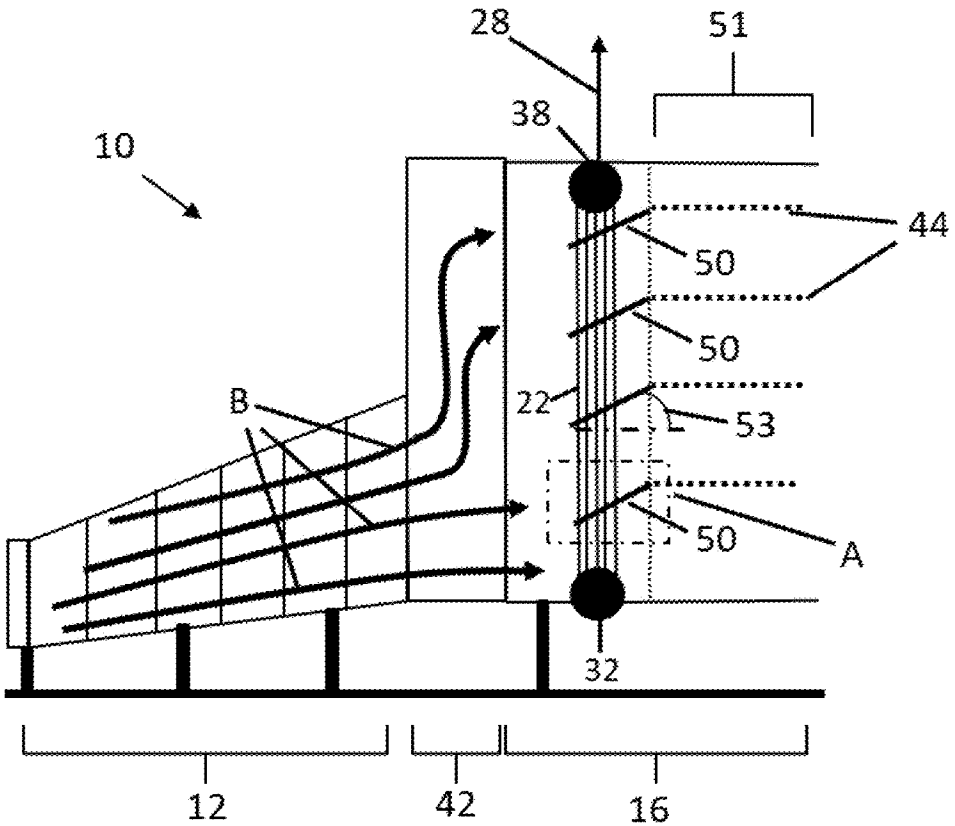
FIG. 3 is a side schematic representation of a portion of a heat recovery steam generator (HRSG)

FIG. 3 illustrates a side view of a portion of a HRSG 10 according to the present embodiments including the inlet duct 12, the inlet plenum 42, and a portion of the superheater section 16. FIG. 3 illustrates a plurality of stepped tube restraints 50 coupled to the plurality of tubes 22. Each of the stepped tube restraints 50 includes a plurality of tube restrains 52 (shown in FIG. 4) arranged such that each restraint 52 is located incrementally higher than an adjacent restraint 52 when moving toward the axially aft end (i.e., adjacent the stack 14) of the HRSG 10. Each restrain 52 may abut an adjacent restraint 52 such that they form stepped tube restraints 50 which act as angled flow guides that help to more evenly direct flow to each portion of the HRSG 10. Each of the stepped tube restraints 50 may form an angle 53 with the axial (or horizontal direction. In one embodiment, the angle may between about 10 degrees and about 60 degrees. In another embodiment, the angle may between about 20 degrees and about 45 degrees. In another embodiment, the angle may between about 25 degrees and about 35 degrees. The angle 53 may be uniform at each vertical location within the HRSG 10. In other embodiments, the angle 53 may vary depending on the vertical height at which the stepped restraint 50 is located. For example, at lower heights, the angle 53 may be shallower (for example between about 10 degrees and 35 degrees), and at higher locations, the angle 53 may be steeper (for example between about 30 degrees and 60 degrees).

Referring still to FIG. 3, a plurality of intermediate (or medium) sized exhaust flows B flow to each portion of the HRSG 10 (lower portions, upper portions, middle portions). By incorporating angled or stepped tube restraints 50 into the HRSG 10, flow may be more evenly distributed to each portion of the HRSG 10. In addition, by incorporating angled or stepped tube restraints 50 into the HRSG 10, the overall flow area (and/or effective flow area) of the HRSG may be opened up, thereby reducing pressure losses across the HRSG 10. In addition, the more even distribution of medium-sized exhaust flows B across the HRSG may lead to an increase in the overall effectiveness of the HRSG 10 due to increased utilization of (i.e., due to the increased mass-flow within) the upper portions of the HRSG 10. Each of the plurality of stepped tube restraints 50 may extend axially (or longitudinally) aft-ward toward the stack 14 (not shown) as they angle vertically upward. Axially aft of each of the stepped tube restraints 50 is a leveled off portion 51 of the HRSG 10 in which the tube restrains 44 extend horizontally aft-ward rather than at an angle. As such, once the stepped restraints 50 distribute exhaust gases to each vertical location of the HRSG 10, exhaust gases may then travel substantially horizontally toward the aft portions of the HRSG 10. (Note: tubes 22 are not illustrated in the leveled off portion 51 of HRSG 10, but would be disposed through the axial length of the HRSG 10, i.e., in the evaporator and economizer sections, as well). Comparing the embodiments of FIGS. 2 and 3, it is possible that the mass flow rate through the bottom portion of the HRSG 10 may decrease in the embodiment of FIG. 3. However, it is expected that the overall exhaust flow rate through the HRSG would be at least as high in the embodiment of FIG. 3, compared to FIG. 2, if not higher. In addition, the exhaust flow in the embodiment of FIG. 3 may not be entirely evenly distributed vertically across the HRSG 10. However, it is expected that the exhaust flow in the embodiment of FIG. 3 would be more evenly distributed than in the embodiment of FIG. 2.

Figure 4:
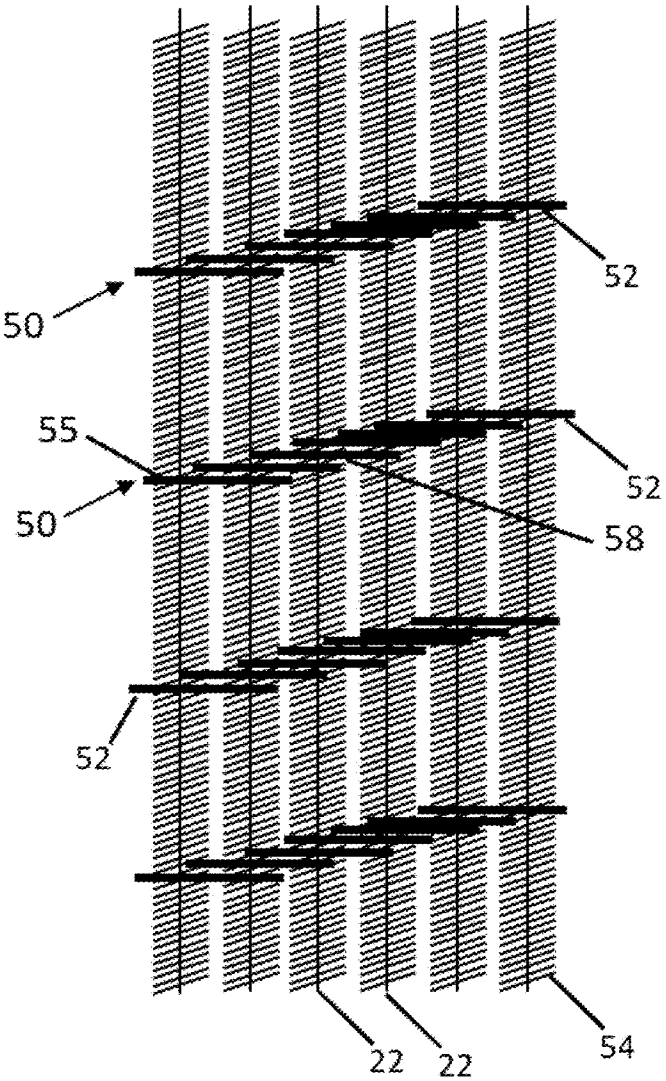
FIG. 4 is an enlarged side view of a plurality of HRSG tubes with stepped tube restraints.

FIG. 4 illustrates an enlarged side-view of the stepped tube restraints 52 and a plurality of tubes 22. Each of the stepped tube restraints 52 may include a plurality of individual plates 52. Each of the plates 52 may be substantially horizontally aligned and may be coupled to one or more of the tubes 22. The tubes 22 vertically support the plates 52. Each plate 52 may be coupled to one or more tubes 22 via welding, mechanical means, U-bolts, compression fit, and or other suitable means. As such, each plate 52 includes a plurality of holes (not shown) through which the tubes 22 may pass. Each tube 22 may include a plurality of fins 54 circumferentially surrounding the tube and vertically spaced through the full vertical height of each tube 22. Each fin 54 may be angled to approximately match the angle or angles of the stepped restraints 52. In other embodiments, each of the fins 54 may be substantially horizontally aligned. In other embodiments, each tube 22 may include a plurality of fins that are angled as well as a plurality of fins that are horizontally aligned (for example, at portions of the tubes 22 proximate the interface(s) with the one or more plates 52).

Referring still to FIG. 4, each of the plates 52 may abut and/or contact one or more adjacent plates 52 such that there is a minimal vertical gap or no vertical gap at all between abutting plates 52. In some embodiments, adjacent and/or abutting plates may be sealed to one another via any suitable means (i.e., via high temperature epoxy, sealant, and/or welding). In other embodiments, adjacent and/or abutting plates may contact one another without any active sealing measures. As such, in some embodiments, a finite percent of exhaust gas flow may pass through the stepped restraints 50 (i.e., in a substantially horizontal direction) between adjacent plates 52. Pass-through exhaust gas flow (i.e., between adjacent plates 52 of one or more stepped restraints) does not necessarily negatively impact the performance of the HRSG 10 since the pass-through exhaust gas flow passes horizontally through the HRSG toward downstream tubes 22, and may continue to transfer heated into the downstream tubes 22 as intended. In addition, pass-through gas flows may be accounted for and factored into the design of the stepped restraints 50, which in turn may allow tolerances (i.e. vertical spacing) between adjacent and/or abutting plates 52, thereby enabling thermal growth between plates 52 at various operating and/or environmental conditions under which the HRSG 10 may operate.

Still referring to FIG. 4, each plate 52 may axially span one or more tubes 22. In the embodiment of FIG. 4, each plate 52 axially spans about 2 tubes 22. As such, in the embodiment of FIG. 4, one or more plates (for example, first plate 55) may extend from an axially upstream outer diameter of a first row of tubes 22 to an axially downstream outer diameter of an adjacent row of tubes 22. Similarly, in the embodiment of FIG. 4, one or more plates (for example, second plate 58) may extend from an axial midpoint of a first row of tubes 22, around an entire circumference of an adjacent second row of tubes 22, to an axial midpoint of an adjacent (i.e., adjacent to the second row of tubes) third row of tubes. In other embodiments, each plate 52 may span 1, 2, 3, 4, 5, a greater number and/or a fractional number of tubes 22. In each of FIGS. 1-4, the HRSG would likely include additional rows of tubes 22 laterally spaced across the HRSG 10 (i.e., behind and/or "into the page of the respective figure, from the perspective of the side views of FIGS. 1-4). Any suitable material may be used to fabricate the plates 52. Suitable materials may include materials that have sufficient resistance to temperature in order to survive the expected internal operating temperatures within the HRSG 10. Because the axially forward end of the HRSG 10 experiences higher temperature than the aft end, the tube restraints (i.e., plates) 52 at the front end of the HRSG 10 may be composed of a higher temperature resistant material than tube restraints 52 at the aft end of the HRSG 10. In addition, each of the plates 52 may be constructed of materials with sufficient strength to provide axial rigidity to the plurality of tubes 22, while simultaneously withstanding the exhaust gases acting on the planar surfaces of the plates 52. In the embodiment of FIG. 4, each plate 52 axially overlaps about 50% with one or more adjacent plates 52. In other embodiments, the axial overlap between adjacent plates may be from about 0% to about 60%. In other embodiments, the axial overlap between adjacent plates may be less than about 40%. In other embodiments, the axial overlap between adjacent plates may be less than about 30%. In other embodiments, the axial overlap between adjacent plates may be less than about 20%. In other embodiments, the axial overlap between adjacent plates may be less than about 10%. In other embodiments, there may be no axial overlap between adjacent plates.

Figure 5:
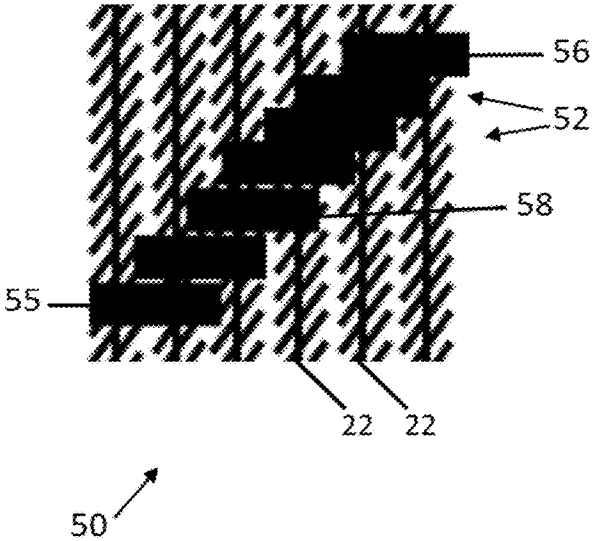
FIG. 5 is an enlarged side view of a plurality of HRSG tubes with stepped tube restraints.

FIG. 5 illustrates an enlarged side-view of a stepped restraint 50 including a plurality of plates 52 coupled to a plurality of tubes 22. The plurality of plates 52 include a first plate 55 located at an axially forward location and at a bottom location of the stepped restrained 50. The plurality of plates 52 also include a second plate 58 located axially aft of and above the first plate 55 (though not necessarily immediately adjacent to first plate 55). The plurality of plates 52 also may include a third plate 56 located axially aft of and above both the first and second plates 55, 58 (though not necessarily immediately adjacent to first and/or second plates 55, 58). The plurality of plates 52 also may include a fourth, fifth, sixth and/or other number of plates similarly arranged in a stepped configuration as illustrated in FIG. 5. In addition, the plurality of plates 52 arranged as a stepped restraint 52 may span six rows of tubes 22 as depicted in FIG. 5 or may span some other number of tubes including but not limited to 1, 2, 3, 4, 5, 7, 8, 9, 10, and/or more than 10. As discussed above, each plate 52 may span about 2 rows of tubes 22 (for example third plate 56) or may at least partially span 3 rows of tubes 22 (for example second plate 58).

Figure 6:
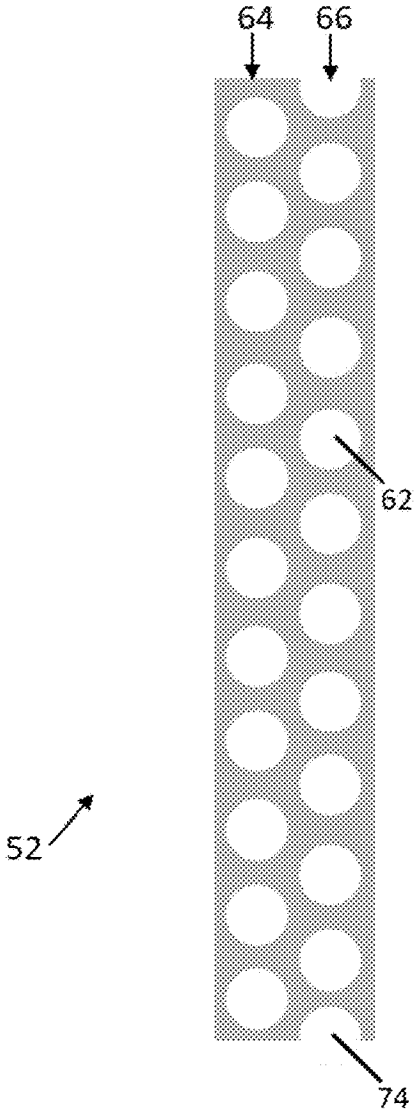
FIG. 6 is an enlarged top view of a tube restraint.

FIG. 6 illustrates an enlarged top-view of a tube restraint (i.e., plate) 52. The plate 52 of FIG. 6 includes a first row of holes 64 disposed within the plate 52 axially upstream of (i.e., axially forward) of a second row of holes 66. The second row of holes 66 may be laterally offset from the first row of holes 64 to conform with a staggered tube arrangement within the HRSG 10. Each hole of the first row of holes 64 and the second row of holes 66 may be positioned within the HRSG 10 such that a tube 22 is disposed therethrough. Each of the first and second rows of holes 64, 66 may include one or more fully circular holes disposed within the plate 52 (for example, hole 62) as well as one or more semicircular holes disposed at an edge of the plate 52 (for example, hole 74). FIG. 6 illustrates an example of a plate 52 that spans two rows of tubes 22 (i.e., corresponding to, for example, plate 56 of FIG. 5). In other embodiments, as discussed above, plate 52 may span other numbers of rows of tubes 22, including 1-10 or more.

Figure 7:
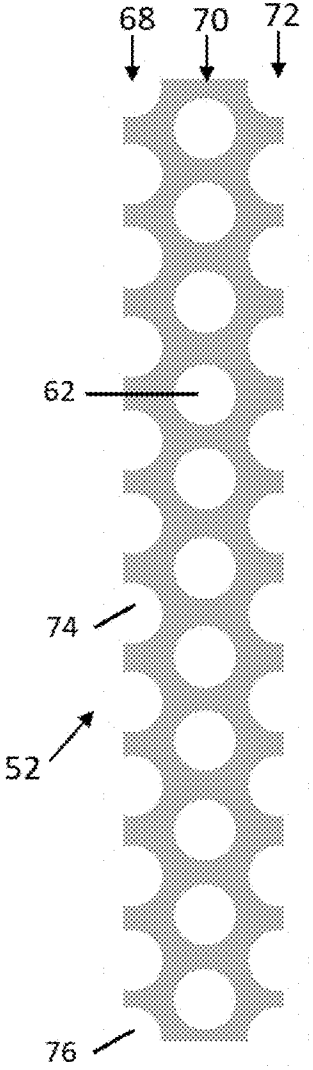
FIG. 7 is an enlarged top view of a tube restraint.

FIG. 7 illustrates an enlarged top-view of a tube restraint (i.e., plate) 52. The plate 52 of FIG. 7 includes a first row of holes 68 partially disposed within the plate 52 axially upstream of (i.e., axially forward) of a second row of holes 70 which in turn is disposed within the plate 52 axially forward of a third row of holes 72. Each of the first and third rows of holes 68, 72 primarily include semicircular holes 74 while the second row of holes 70 primarily includes fully circular holes 62. The second row of holes 70 may be laterally offset from each the first and third rows of holes 68, 72 to conform with a staggered tube arrangement within the HRSG 10. Each hole of the first, second, and third rows of holes 68, 70, 72 may be positioned within the HRSG 10 such that a tube 22 is disposed therethrough. Each of the first and third rows of holes 68, 72 may include one or more quarter circular holes 76 (i.e., "quarter circle holes") disposed at one or more corners of the plate 52. FIG. 7 illustrates an example of a plate 52 that spans portions of three rows of tubes 22 (i.e., corresponding to, for example, plate 58 of FIG. 5). In other embodiments, as discussed above, plate 52 may span other numbers of rows of tubes 22, including from about 1 to about 10 or more.

Figure 8:
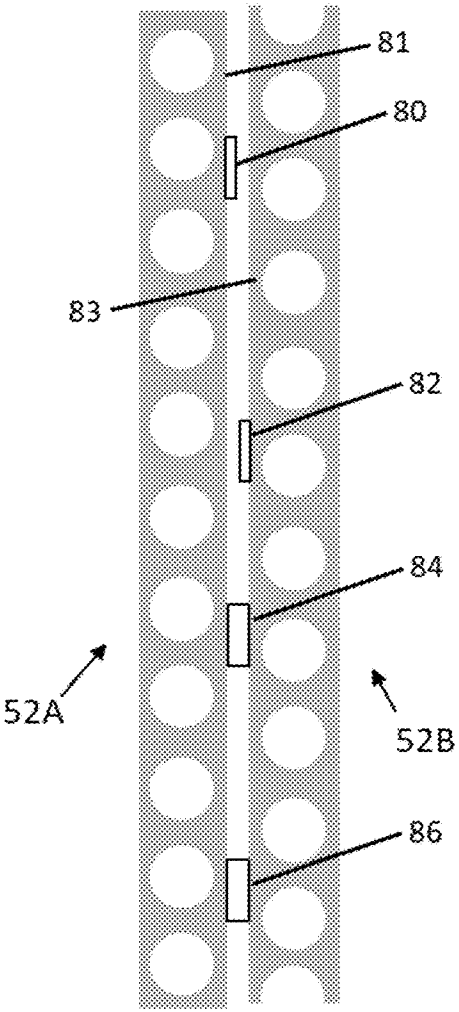
FIG. 8 is an enlarged top view of a plurality of tube restraints.

FIG. 8 illustrates an enlarged top-view of a plurality of tube restraints (i.e., plates) 52A, 52B. A first plate 52A is axially upstream of a second plate 52B. Each of the first and second plates 52A, 52B includes a single row of holes disposed therethrough (through which a single row of tubes 22 are disposed). One or more axial spacers 80, 82, 84 may be disposed between the plurality of tube restraints (i.e., plates) 52A, 52B. A first axial spacer 80 may be coupled to an axially downstream edge 81 of the first plate 52A with an axial gap between the first axial spacer 80 and the second plate 52B. Similarly, a second axial spacer 82 may be coupled to an axially upstream edge 83 of the second plate 52B with an axial gap between the second axial spacer 82 and the first plate 52A. Similarly, third and fourth axial spacers 84, 86 may be coupled to both an upstream edge 83 of the second plate 52B as well as a downstream edge 81 of the first plate 52A. Each of the first, second, third, and fourth axial spacers 80, 82, 84, 86 may be used to distribute an axial force or load from one plate to another as the plates 52A, 52B and/or tubes 22 flex axially due to exhaust gases acting thereupon during operation. In other embodiments, the plurality of tube restraints (i.e., plates) 52A, 52B may include various numbers of first, second, third, and fourth axial spacers 80 laterally spaced between the first and second plates 52A, 52B.

Figure 9:
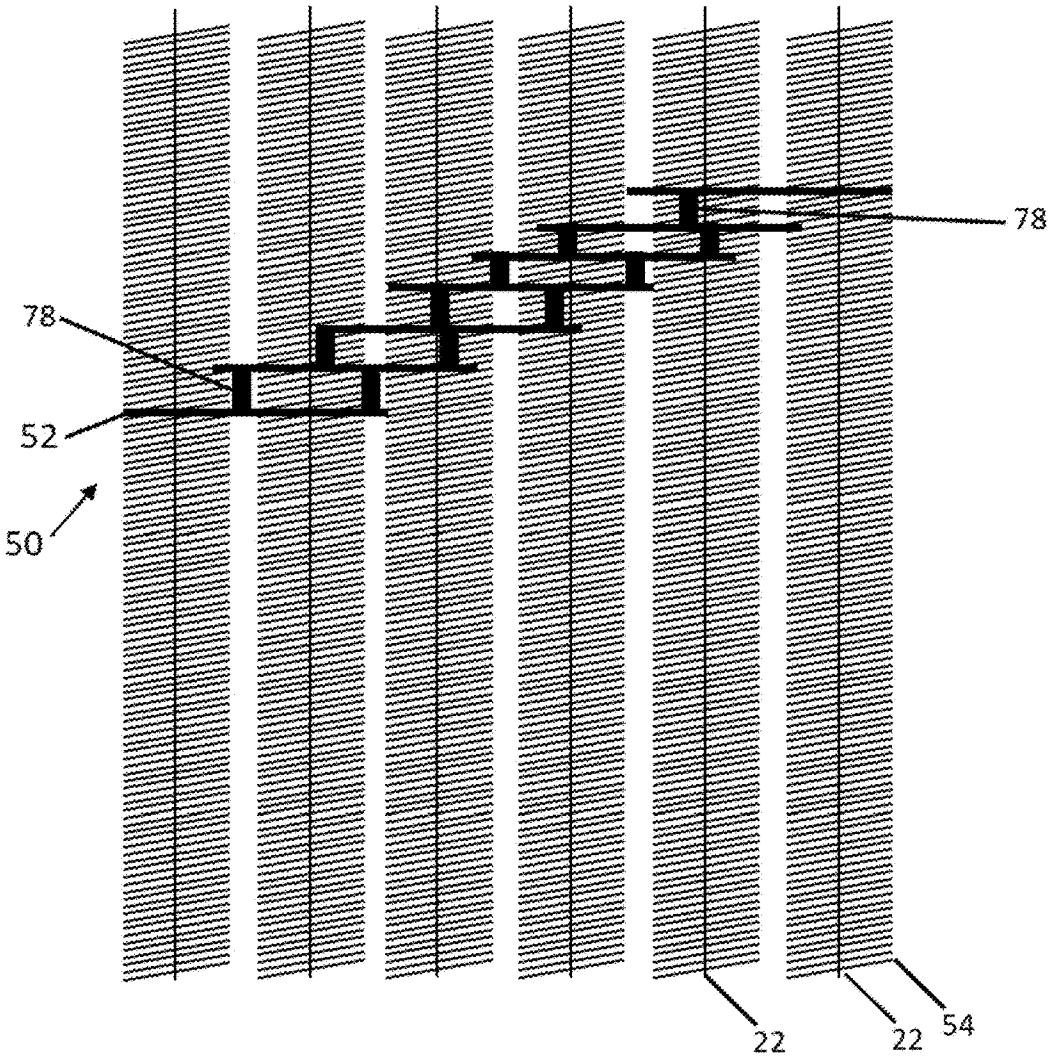
FIG. 9 is an enlarged side view of a plurality of HRSG tubes with stepped tube restraints.

FIG. 9 illustrates an enlarged side-view of a plurality of tubes 22 with a stepped tube restraint 50 disposed thereon, axially supporting the plurality of tubes and acting as a flow vane to help guide exhaust gases to upper portions of the HRSG 10. The embodiment of FIG. 9 includes a plurality of vertical spacers 78 disposed between adjacent plates 52. The vertical spacers 78 may enable a vertical gap between adjacent plates 52, thereby allowing for a finite amount of exhaust gases to pass horizontally through each vertical gap. In addition, the vertical spacers 78 may enable differential thermal growth between the plates 52, tubes 22, fins 54, and other components of the HRSG 10. In some embodiments the vertical spacers 78 may be used in addition to axial spacers 80, 82, 84, 86 (i.e., illustrated in FIG. 8). In other embodiments, the vertical spacers 78 may simultaneously act both as vertical spacers 78 as well as axial spacers 80, 82, 84, 86. Note: the vertical spacing may be exaggerated in the illustration of FIG. 9.

Figure 10:
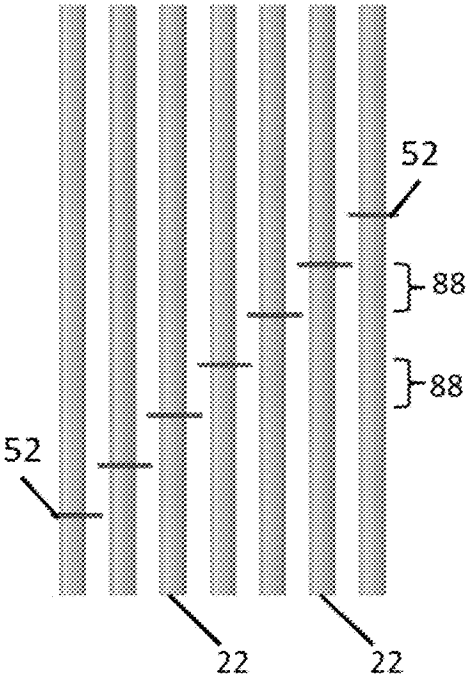
FIG. 10 is an enlarged side view of a plurality of HRSG tubes with stepped tube restraints.

FIG. 10 illustrates an enlarged side-view of a plurality of tubes 22, corresponding to, for example, those shown in box A of FIG. 3. In the embodiment of FIG. 10, each tube restraint 52 is vertically offset from one or more adjacent tube restraints 52, thereby defining a vertical spacing 88. In the embodiment of FIG. 10, the vertical spacing 88 is greater relative to the longitudinal width of each tube restraint 52 compared to the embodiment of FIG. 4. For example, in the embodiment of FIG. 10, the vertical spacing 88 is approximately equal to the longitudinal width of each tube restraint 52. In other embodiments, the vertical spacing 88 may be greater than or less than the longitudinal width of each tube restraint 52. An HRSG 10 including the tube restraint 52 arrangement included in FIG. 10 may include fins 54 (shown in FIGS. 4, 5, and 9) surrounding each tube even through the schematic of FIG. 10 is illustrated without fins.

Figure 11:
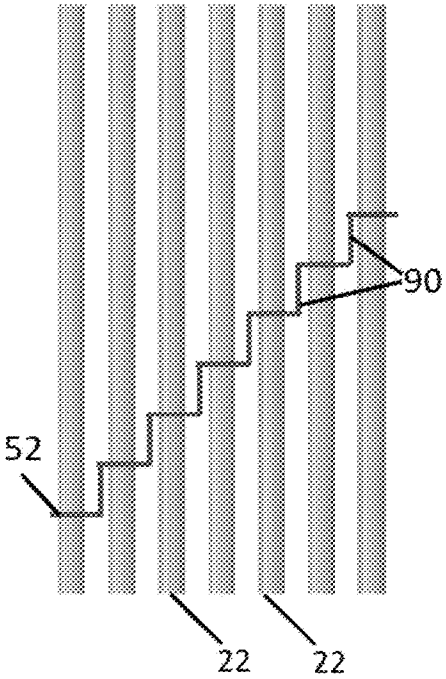
FIG. 11 is an enlarged side view of a plurality of HRSG tubes with stepped tube restraints.

FIG. 11 illustrates an enlarged side-view of a plurality of tubes 22, corresponding to, for example, those shown in box A of FIG. 3. In the embodiment of FIG. 11, each tube restraint 52 is connected to one or more adjacent tube restraints 52 via one or more vertical blockers 90. The vertical blockers 90 help to encourage flow vertically upward (as it moves longitudinally through the HRSG 10) toward the higher portions of the HRSG 10. In other hybrid embodiments, the HRSG 10 may include some tube restraints 52 that are connected to one or more adjacent tube restraints 52 via one or more vertical blockers 90 (i.e., similar to FIG. 11), as well as one or more tube restraints 52 that are vertically offset from (i.e., via vertical spacing 88) one or more adjacent tube restraints (i.e., similar to FIG. 10). An HRSG 10 including the tube restraint 52 arrangement included in FIG. 11 may include fins 54 (shown in FIGS. 4, 5, and 9) surrounding each tube even through the schematic of FIG. 11 is illustrated without fins.

Figure 12:
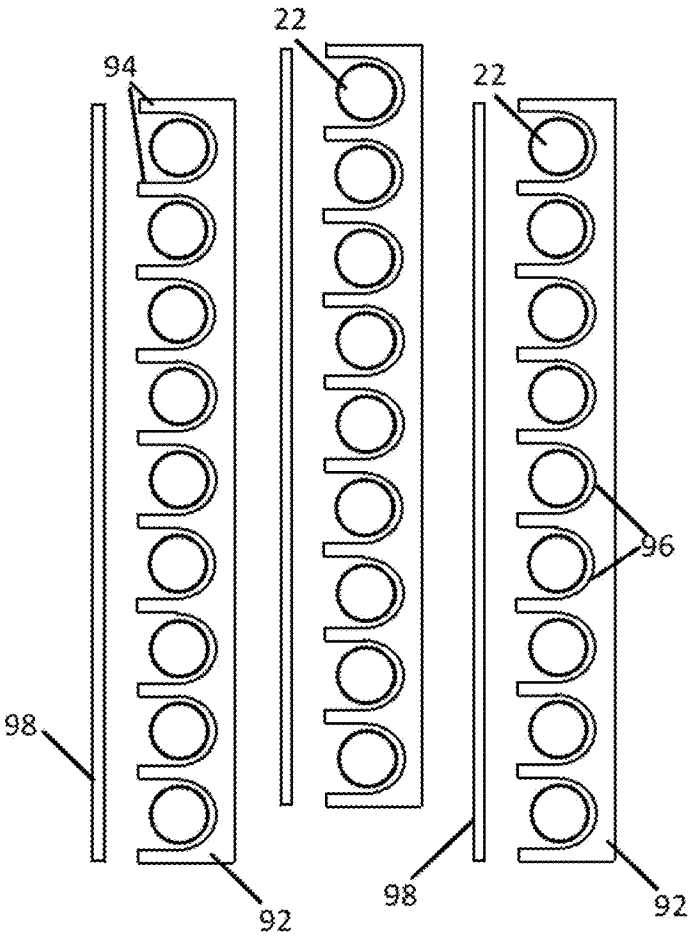
FIG. 12 is an enlarged top view of a plurality of HRSG tubes with scalloped tube restraints.

FIG. 12 illustrates an enlarged top-view of a plurality of scalloped tube restraints 92. Each scalloped tube restraint 92 includes a plurality of semicircular portions 96, which may be laterally spaced within the scalloped tube restraint 92 such that they interface with the spacing and contouring to match each row of tubes 22. A plurality of tangs 94 extend between adjacent tubes 22 as well as longitudinally forward of the tubes 22. The tangs 94 may be coupled to a lateral support bar 98 which vertically supports the scalloped tube restraints 92 and keeps them anchored to the plurality of tubes 22. The scalloped tube restraints 92 may be coupled to the lateral support bars 94 via any suitable means including, nuts/bolts, welding, tongue and groove, dovetail, U-bolt, and other suitable means. In other configurations, the scalloped tube restraint 92 may be disposed at the forward end of each row of tubes while the lateral support bar 94 may be disposed at the aft end of each row of tubes. The lateral support bars 94 are illustrated as detached from the scalloped tube restraints 92 (i.e., unassembled). When viewed from the side, the scalloped tube restraints 92 of FIG. 12 appear similar and/or identical to other tube restraint configurations disclosed herein. Stated otherwise, the scalloped tube restraints 92 may be arranged in a stepped configuration. As such, HRSGs according to the present embodiments may include tube restraints 52, 92 that are both scalloped and in a stepped arrangement. Similarly, the scalloped tube restraints 92, when assembled in a stepped configuration, act as guide vanes to help distribute exhaust flow to the upper portions of the HRSG 10.

Figures 13, 14, 15, 16:
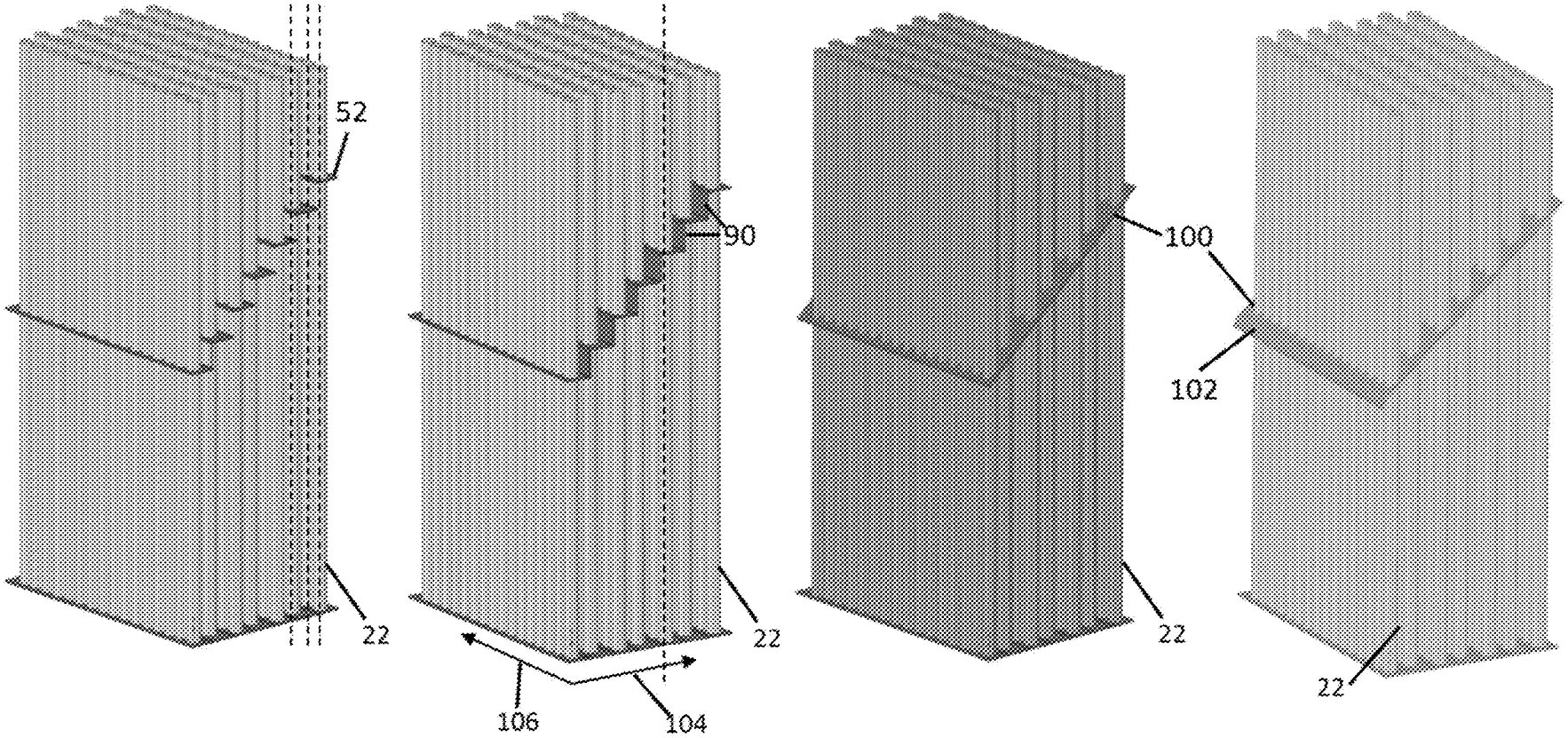
FIG. 13 is an enlarged perspective view of a plurality of HRSG tubes with stepped tube restraints.
FIG. 14 is an enlarged perspective view of a plurality of HRSG tubes with stepped tube restraints.
FIG. 15 is an enlarged perspective view of a plurality of HRSG tubes with an angled tube restraint.
FIG. 16 is an enlarged perspective view of a plurality of HRSG tubes with an angled tube restraint, according to aspects of the present embodiments.

FIG. 13 illustrates an enlarged perspective view of a plurality of tubes 22 coupled to a plurality of tube restraints 52 vertically offset from each other, similar to the side view of FIG. 10.

FIG. 14 illustrates an enlarged perspective view of a plurality of tubes 22 coupled to a plurality of vertical blockers 90 connecting adjacent tube restraints 52, similar to the side view of FIG. 11. A lateral direction 106 and longitudinal direction 104 (i.e., pointing toward the back end of the HRSG adjacent the stack 14) are also illustrated in FIG. 14.

FIG. 15 illustrates an enlarged perspective view of a plurality of tubes 22 including an angled (or inclined) tube restraint 100. The angled tube restraint 100 achieves the same function as the stepped tube restraint arrangements of other embodiments disclosed herein, (i.e., evenly distributing flow across the full vertical height of the HRSG 10). The HRSG 10 may include multiple angled tube restraints 100 distributed vertically across the HRSG 10 similar to the stepped tube restraints 50 illustrated in FIG. 3. Each angled tube restraint 100 may be inclined at the same angle as and/or at different angles than other angled tube restraints 100. The angled tube restraint 100 may be a substantially planar plate with oval or elliptically shaped holes disposed therethrough to allow the cylindrical tubes 22 to run therethrough at an angle. The angled tube restraints 100 may be composed of any suitable materials, as discussed herein, and may be coupled to the tubes via any suitable means including U-bolt, welding, compression fit, etc. The angled tube restraints 100 may form an angle with the horizontal or longitudinal axis between about 10 degrees and about 60 degrees, between about 20 degrees and about 45 degrees, and/or between about 25 degrees and about 35 degrees.

FIG. 16 illustrates an enlarged perspective view of a plurality of tubes 22 including an angled (or inclined) tube restraint 100. FIG. 16 also illustrates a scoop 102 extending the full lateral width of the plurality of tubes 22, and coupled to a forward edge of the angled tube restraint 100. The scoop 102 extends forward of the tubes 22 and angled tube restraint 100, and acts to help guide flow into the upper portions of the HRSG. Each scoop 102 may be oriented such that it is at a steeper angle than, a shallower angle than, and/or substantially the same angle as the angled tube restraint 100 to which it is coupled. In other embodiments, the HRSG 10 may include scoops 102 that are oriented at different angles so as to optimally tune the flow distribution at each vertical location within the HRSG 10. As such, in some embodiments, the scoops 102 may be adjustable once installed to allow the as-installed flow characteristic within each individual HRSG 10 to be enhanced as needed. The scoops 102 may be attached to the angled tube restraints via welding, U-bolt, hinges, compression fit, linkages, brackets, and/or via other suitable means. The scoops 102 may be used with any of the HRSG 10 and/or tube restraint 52 configurations disclosed herein.

In operation, the stepped, scalloped, and/or angled tube restraints 50, 92, 100 of the present embodiments help to distribute the exhaust gases throughout the full vertical height of the HRSG 10. In particular, the stepped, scalloped, and/or angled tube restraints 50, 92, 100 open up the overall flow area (and/or effective flow area) of the HRSG 10 which in turn may reduce pressure losses and draft losses and may increase utilization of the upper portions of the HRSG 10 via increased mass flow of exhaust gases in the upper portions of the HRSG 10. Because conventional (i.e., horizontal) tube restraints 44 may already be employed in HRSG applications, HRSGs with stepped, scalloped, and/or angled tube restraint 50, 92, 100 configurations do not present a significant material cost increase over conventional designs because only incrementally more material may be required for the stepped configuration compared to a conventional horizontal configuration. For example, the tube restraints 52 are configured in a stepped/angled arrangement rather than in a purely horizontal configuration. Similarly, only incrementally more labor (i.e., and labor cost) may be associated with a stepped/angled tube restraint configuration compared to a conventional horizontal configuration because the same construction techniques (for example welding the tube restraints to the HRSG tubes 22) may be employed for both configurations. In addition, the stepped tube restraint 50 configuration may present a more robust solution to flow distribution within the HRSG 10 compared to, for example, moveable guide vanes in the inlet duct 12 and or inlet plenum 42 since moveable guide vanes may increase the risk of damage to downstream HRSG tubes 22 if they become dislodged due to turbulent exhaust flows in the inlet duct 12. In addition, stepped/angled tube restraints 50, 100 may present a greatly reduced cost burden compared to moveable guide vanes.

The stepped tube restraints 50 of the present embodiments may include chamfers, contouring, fillets, tapering, machined features, bolt holes disposed therethrough, and/or other features that may be deemed necessary to construct the configurations described herein. Configurations of the present claimed embodiments may include a single planar tube restraint 100 that is angled and spans several HRSG tubes 22 rather than a plurality of horizontal tube restraints (i.e., plates) 52 arranged in an ascending stepped configuration according to FIGS. 3-5 and FIG. 9. For example, in embodiments that include angled tube restraints, each angled tube restraint may be configured as a single angled tube restraint axially and/or laterally spanning one or more rows of tubes 22, and/or as a plurality of adjacent and/or coplanar angled tube restraints axially and/or laterally spanning one or more rows of tubes 22. Each of the HRSG arrangements and components thereof illustrated in FIGS. 2-16 may also include any and/or all of the components and arrangements illustrated in FIGS. 1-16 and discussed in the accompanying paragraphs above.

The present embodiments have been described primarily in terms of applications within heat recovery steam generators (HRSG). However, several other applications are possible including boilers, heaters, heat exchangers, and other cross-flow and/or counter-flow type heat exchangers.

Although specific features of various embodiments of the present disclosure may be shown in some drawings and not in others, this is for convenience only. In accordance with the principles of the present disclosure, any feature of a drawing may be referenced and/or claimed in combination with any feature of any other drawing.

This written description uses examples to disclose the embodiments of the present disclosure, including the best mode, and also to enable any person skilled in the art to practice the disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A heat recovery steam generator (HRSG) comprising:

a plurality of vertically aligned HRSG tubes arranged in multiple rows; and a plurality of stepped tube restraints coupled to the plurality of vertically aligned HRSG tubes, each stepped tube restraint of the plurality of stepped tube restraints comprising a plurality of tube restraints;

wherein the plurality of tube restraints is arranged in an array such that each successive tube restraint is vertically higher than and axially aft of an adjacent tube restraint; and wherein each HRSG tube of the plurality of vertically aligned HRSG tubes comprises a plurality of angled fins.

2. The heat recovery steam generator of claim 1, wherein each tube restraint of the plurality of tube restraints comprises a substantially planar plate.

3. The heat recovery steam generator of claim 2, wherein each substantially planar plate is horizontally aligned.

4. The heat recovery steam generator of claim 2, wherein at least one tube restraint of the plurality of tube restraints comprises at least one circular hole disposed therethrough, and wherein at least one tube restraint of the plurality of tube restraints comprises at least one of a semi-circular hole and a quarter-circle hole disposed therethrough.

5. The heat recovery steam generator of claim 1, wherein the plurality of stepped tube restraints is disposed within a superheater section of the HRSG.

6. The heat recovery steam generator of claim 1, wherein each tube restraint of the plurality of tube restraints is coupled to at least one vertically aligned HRSG tube of the plurality of vertically aligned HRSG tubes via at least one of a weld, a compression fit, and a U-bolt.

7. The heat recovery steam generator of claim 1, wherein each stepped tube restraint of the plurality of stepped tube restraints further comprises between about 2 and about 10 tube restraints.

8. The heat recovery steam generator of claim 1, wherein each stepped tube restraint of the plurality of stepped tube restraints spans between about 5 and about 10 rows of vertically aligned HRSG tubes.

9. The heat recovery steam generator of claim 1, wherein each row of the multiple rows of vertically aligned HRSG tubes is laterally staggered from adjacent rows of vertically aligned HRSG tubes.

10. The heat recovery steam generator of claim 9, wherein each tube restraint axially spans between about 1 and about 3 rows of vertically aligned HRSG tubes, and wherein at least one tube restraint of the plurality of tube restraints is scalloped.

11. The heat recovery steam generator of claim 1, further comprising at least one axial spacer axially disposed between one or more tube restraints of the plurality of tube restraints.

12. The heat recovery steam generator of claim 1, further comprising at least one vertical spacer vertically disposed between one or more pairs of tube restraints of the plurality of tube restraints.

13. The heat recovery steam generator of claim 1, wherein each stepped tube restraint of the plurality of stepped tube restraints forms an angle with a horizontal axis between about 10 degrees and about 60 degrees.

14. The heat recovery steam generator of claim 13, wherein at least one stepped tube restraint of the plurality of stepped tube restraints forms an angle with a horizontal axis that is different from at least one other stepped tube restraint of the plurality of stepped tube restraints.

15. The heat recovery steam generator of claim 14 further comprising:

at least one scoop coupled to a forward edge of at least one stepped tube restraint of the plurality of tube restraints;

wherein the plurality of stepped tube restraints is disposed within a superheater section of the HRSG;

wherein each tube restraint of the plurality of tube restraints is coupled to at least one vertically aligned HRSG tubes of the plurality of vertically aligned HRSG tubes via at least one of a weld, a compression fit, and a U bolt; and wherein each tube restraint of the plurality of tube restraints axially spans between about 1 and about 3 rows of vertically aligned HRSG tubes.

16. A heat recovery steam generator (HRSG) comprising:

a plurality of vertically aligned vertically aligned HRSG tubes;

a plurality of stepped tube restraints coupled to the plurality of vertically aligned HRSG tubes, each stepped tube restraint of the plurality of stepped tube restraints comprising a plurality of tube restraints; and at least one vertical spacer coupled between at least one pair of adjacent tube restraints of the plurality of tube restraints;

wherein each stepped tube restraint of the plurality of stepped tube restraints forms an angle with a horizontal axis between about 10 degrees and about 60 degrees.

17. The heat recovery steam generator of claim 16, further comprising a plurality of horizontally aligned tube restraints disposed in the HRSG downstream of the plurality of stepped tube restraints.

18. A heat recovery steam generator (HRSG) comprising:

a plurality of vertically aligned HRSG tubes; and a plurality of angled tube restraints coupled to the plurality of vertically aligned HRSG tubes, each angled tube restraint of the plurality of angled tube restraints comprising one or more planar tube restraints;

wherein each angled tube restraint of the plurality of angled tube restraints forms an angle with a horizontal axis between about 10 degrees and about 60 degrees; and wherein at least one angled tube restraint of the plurality of angled tube restraints forms an angle with a horizontal axis that is different from at least one other angled tube restraint of the plurality of angled tube restraints.

* * * * *